US005081853A

United States Patent [19]

Salyer

[11] Patent Number: 5,081,853

[45] Date of Patent: Jan. 21, 1992

[54] ADHESIVELY SECURABLE POSTLESS EARRING

[75] Inventor: Amy L. Salyer, Warrenville, Ill.

[73] Assignee: Ear Resistible Ideas, Inc., Warrenville, Ill.

[21] Appl. No.: 671,025

[22] Filed: Mar. 18, 1991

Related U.S. Application Data

[63] Continuation of Ser. No. 513,213, Apr. 23, 1990, abandoned.

[51] Int. Cl.[5] ..... A44C 7/00

[52] U.S. Cl. ..... 63/12; 63/14.1; 63/DIG. 1

[58] Field of Search ..... 24/DIG. 11, 304, 705; 40/630, 1.5; 63/12, DIG. 1, 2, 14.1, 14.3

[56] References Cited

U.S. PATENT DOCUMENTS 2,292,024 8/1942 Dreher ..... 24/DIG. 11 X
2,879,567 3/1959 O'Connell ..... 63/29.1 X
2,975,538 3/1961 Murfin ..... 40/1.5 X
3,996,679 12/1976 Warneke ..... 40/1.5
4,220,016 9/1980 Frenger ..... 63/DIG. 1 X

*Primary Examiner*—Kenneth J. Dorner
*Assistant Examiner*—J. Bonifanti
*Attorney, Agent, or Firm*—Levisohn, Lerner & Berger

[57] ABSTRACT

A comfortable, selectively removable earring comprises a decorative ornament portion, a heat and cold insulating as well as soft felt backing layer and a piece of two-sided adhesive-like tape. The felt backing is permanently secured to the earring ornament. The two-sided adhesive-like tape is overlayed on top of the felt backing. When desired to be worn, the wearer removes the paper covering from the exterior side of the two-sided adhesive-like tape to reveal the sticky adhesive. The earring can then be pressed against the ear and secured in place. It can be easily peeled off, as desired. For subsequent wearings of the earring, another piece of two side adhesive-like tape is overlayed onto the prior-used adhesive. Alternatively, the used adhesive can be removed from the felt backing and replaced with a new piece of two-sided adhesive-like tape.

5 Claims, 2 Drawing Sheets

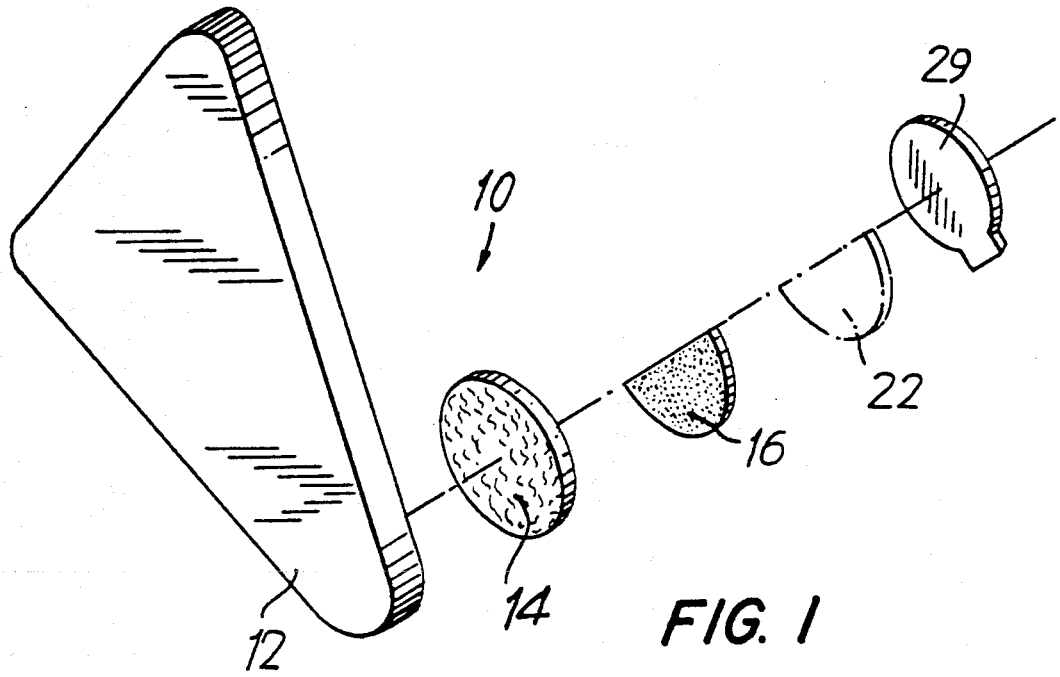
FIG. 1
FIG. 2
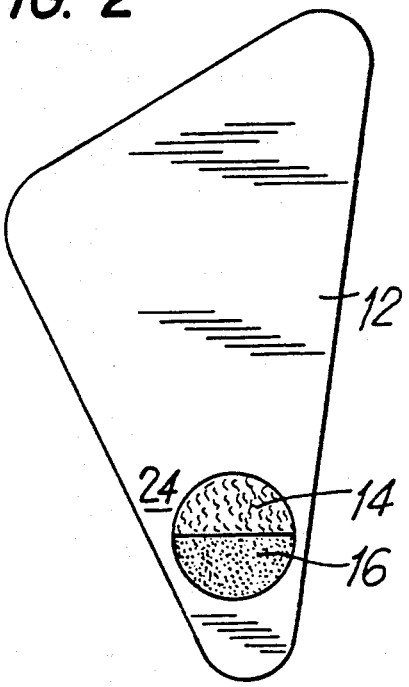
FIG. 3
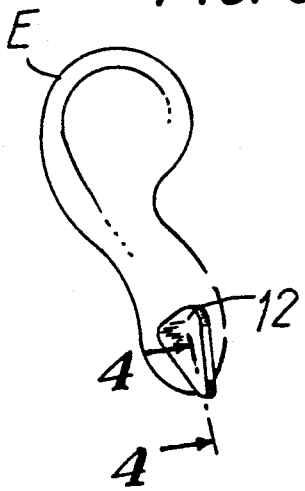

ADHESIVELY SECURABLE POSTLESS EARRING

This is a file wrapper continuation application of application Ser. No. 07/513,213 filed Apr. 23, 1990, now abandoned.

FIELD OF THE INVENTION

This invention relates to earring jewelry and more particularly to earring jewelry attachment devices. An object sought to be accomplished by the present invention is a postless, clipless, removable earring providing maximum comfort to the wearer and, in addition, minimizing heat and cold sensitivity of the earring. A felt layer of material is interposed between a two-sided adhesive tape and provides a comfortable insulative backing layer.

BACKGROUND OF THE INVENTION AND DESCRIPTION OF THE PRIOR ART

An earring is typically attached to an ear with a clip or a post. Those attachment devices can be uncomfortable, tugging at the ear and getting in the way when holding a telephone or other device to the ear. The posts can stab the wearer, too, when the wearer's ear is pressed back, as, for example, by a snug-fitting hat, a kiss to the cheek, etc.

Metallic earrings, especially silver and gold are highly desirable from a fashion, value, and ease of manufacturing standpoint. However, in certain temperature conditions and, when equipped with posts or clips, metallic earrings can be uncomfortable, when pressed against the wearer's ear. This is because metallic earrings, being good heat/cold conductors, adapt quickly to the temperature of the surroundings. Thus, a metallic earring, without clips or a post, is highly desirable. It must, nevertheless, be selectively secured to the wearer's ear (as styles often change) and, in addition, it should be insulated from the wearer's ear for maximum comfort.

The following list of patents were uncovered pursuant to a preliminary patentability search among the records then available in the United States Patent and Trademark Office: 1,140,975; 2,975,538; 3,831,398; 4,220,016; 4,273,145; 4,511,608; and 4,745,934.

The Frenger patent, U.S. Pat. No. 4,220,016 seems the closest reference and relates to a piece of decorative jewelry. A flexible and resilient pad is secured to the back side of the decorative portion of the device to enable attachment to the wearer. This is, according to the disclosure, accomplished by a layer of adhesive 14 and a second layer of adhesive 10 which secure a flexible and resilient material to a back plate 8. According to the disclosure therein, the back plate 8 is made from metal (copper being preferred) and the sheet of flexible and resilient material is made "as thin as possible." This, according to the disclosure, is to ensure "good heat transfer from the body of the wearer to the jewel." The present invention, on the other hand, contemplates a heat insulating thickness of material located between the decorative portion of the earring and the wearer's ear.

The other references generally relate to decorative devices for being selectively secured to a person or to specific adhesives and are believed to be of background interest.

SUMMARY OF THE INVENTION

It is an object of the invention to provide an earring having an attachment device for comfortably removably securing the earring to the ear.

It is also an object of the invention to provide an earring secured to the ear using only an adhesive i.e., without post or a clip about the earlobe.

It is another object of the invention to provide an earring which can be repeatedly attached to an ear using an adhesive material.

It is a further object of the present invention to provide an earring which is heat and cold insulated from the wearer's ear. This is especially important where the earring is made from precious metal such as gold or silver.

It is a further object of the present invention to provide a simple and inexpensive mechanism for removably securing the earring to the wearer's ear which also eliminates the post and clip.

These and other objects of the invention are provided by an earring having in the preferred embodiment, a felt backing and a two sided adhesive-like tape thereon. The felt backing is permanently secured to the earring and insulates the earring from the ear. It is soft and pliable to conform to the ear portion against which it rests. The two sided adhesive is preferably fixedly attached to the felt backing. After peeling away one of the paper covers from one side of the adhesive, the tape is secured to the felt backing. When the earring is to be worn, the other paper sheet covering the other adhesive side is removed to expose the adhesive. It is then securable to an ear. For subsequent wearings, another piece of two-sided adhesive may be overlayed onto the prior adhesive. Alternatively, a new piece of two-sided adhesive is placed on the felt backing after the used piece of two-sided adhesive is first removed and discarded.

BRIEF DESCRIPTION OF THE DRAWINGS

FIG. 1 is an exploded perspective view of the earring, felt-like pad, a first adhesive portion, a second adhesive portion and the tab for the second adhesive portion;

FIG. 2 is a rear elevation view of an earring constructed according to this invention;

FIG. 3 is a perspective view of the earring shown in FIGS. 1 and 2, secured to an ear;

DETAILED DESCRIPTION OF THE INVENTION AND THE PREFERRED EMBODIMENT

Figure 4:
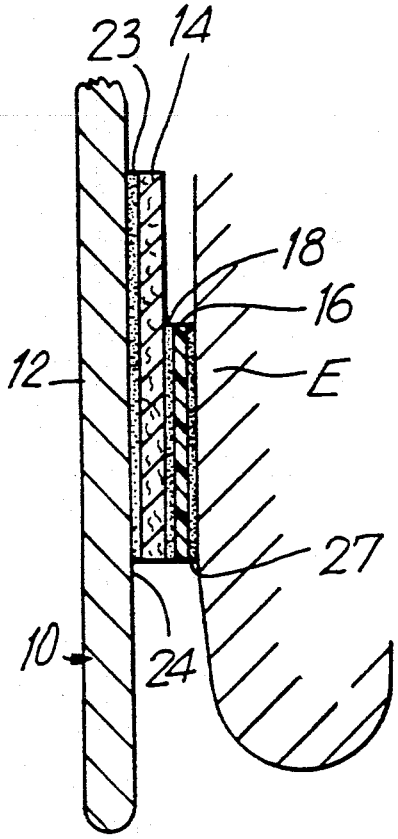
FIG. 4 is a cross-sectional view taken along lines 4—4 of FIG. 3.
Figure 5:
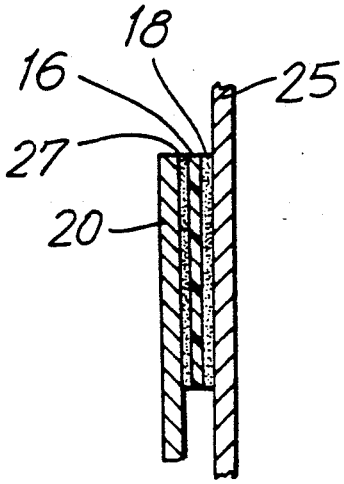
FIG. 5 is a cross-sectional view of one of the two-sided adhesive tabs, prior to use, i.e., with both sheets of release paper secured to the adhesive surfaces.
Figure 6:
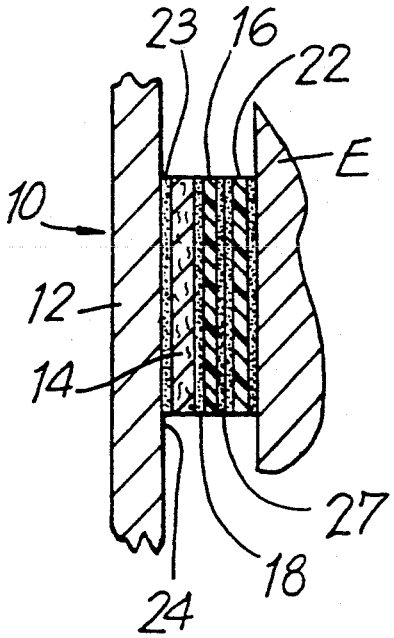
FIG. 6 is a cross-sectional view, similar to that shown in FIG. 4, yet with two two-sided adhesive members having been applied to the earring and with the two-sided adhesive members being the same size as the felt-like material.

Referring to FIGS. 1 and 2, the preferred embodiment 10 of the earring constructed according to this invention includes a decorative jewelry ornament portion 12, a backing layer or insulating pad 14 and a two sided adhesive portion 16. The decorative ornament is lightweight, preferably made from gold or silver. Ease of manufacturing and perceived value to the consuming public dictates the materials used for the ornament portion. A flat back portion 24 of the ornament receives the backing layer or insulating pad 14. The backing layer 14 is made from a soft, pliable and heat insulating material. Felt is currently the preferred material. It is permanently secured to the ornament 12 at back portion 24 by using one-drop gel-type glue or other conventional securing materials 23 (see FIGS. 4 and 6). The felt, due to its flexibility, i.e., lack of rigidity can be conformed to even wavy, convex or concave back portions of the earring.

The adhesive portion, a strip or circular segment 16 is then attached to the felt backing 14. The paper backing or cover sheet 25 on a first side 18 of the strip 16 is removed to expose the adhesive substance. This allows the two-sided adhesive to be pressed onto the backing layer and secured thereto. The earring is now manufactured in its ready for sale condition. It is also ready to be worn by the wearer.

When it is desired to wear the earring, the cover paper 20 from the exterior side of the two-sided adhesive tape is removed and discarded. This reveals and exposes the adhesive substance 27 of the other side of the two sided adhesive. This adhesive substance secures the earring 10 to an ear E, when it is pressed firmly against the ear, which is facilitated by pressing the ornament portion against the earlobe.

After wearing, the earring 10 can be removed from the ear simply by pulling the earring with enough force to overcome the adhesive. Accordingly, the adhesive is selected to have adhesive properties sufficient to secure the earring during use while enabling safe removal by pulling the earring from the ear. When the earring is removed, the backing layer, of course, remains on the ornament. Suitable adhesives having the desired properties to secure and yet enable safe removal have been found to include the 3M brand of two sided tape and the adhesive tabs provided for LEE'S press-on nails.

To reuse the earring, a new adhesive portion 22 is applied over the prior adhesive portion 16. This is done by removing the paper cover from the first side 31 of the adhesive portion to expose the adhesive substance. It is then placed over and in contact with the exposed and used adhesive portion 27 of the prior used adhesive 16. Thus, a new adhesive portion 22 overlays the used adhesive 16, is desired to use the earring again, the paper cover 29 is removed from the outside of the tab to expose the adhesive substance. The earring is then pressed against the ear. Additional wearings of the earring can be similarly accomplished by overlaying new pieces of two-sided adhesive material over used portions. Alternatively, of course, the used adhesive materials can be removed from the felt material and a new piece of two-sided adhesive placed thereon. This has been easily accomplished by placing a drop of water on the used adhesive tab, waiting a bit of time (a few seconds) and then removing the adhesive tab from the felt. However, it is then necessary to wait until the felt pad dries completely before reattaching a new adhesive tab.

Although a preferred embodiment has been described and illustrated the invention is not intended to be limited to the exact embodiment. The scope of the invention is intended to be determined by the claims interpreted in light of the prior art.

I claim:

1. A postless and clipless earring and associated multiple mechanisms for reusably securing the earring to an ear comprising:

a decorative jewelry ornament portion having a back portion which is substantially flat and thereby defining that portion of the earring intended to be secured to the ear;

a thermal insulative and flexible felt-like backing layer, fixedly secured to said back portion, said backing layer providing heat and material insulation between said back portion and the ear upon which it is intended to be worn; and said associated multiple mechanisms comprising selectively replaceable earring securing means for holding, in a selectively removable fashion, said earring to an ear, each of said securing means comprising a two-sided adhesive layer, each side originally provided with a sheet of release paper, the removal of the first of said sheets of release paper thereby exposing a first side of said two-sided adhesive layers, and providing the means for removably securing said securing means to said backing layer, and the selective removal of the second sheet of said release paper thereby exposing a second side of said two-sided adhesive layer and providing the means for removably securing said earring to an ear.

2. An earring and associated multiple mechanisms as claimed in claim 1, wherein said back portion is heat conducting.

3. An earring and associated multiple mechanisms as claimed in claim 1 wherein said securing means is alternatively selectively securable directly to said backing layer or to a previously used two-sided adhesive layer, itself previously secured to said backing layer.

4. An earring and associated multiple mechanisms as claimed in claim 1 wherein said backing layer is conformable to both the back portion of said ornament portion and to the surface configuration of an ear.

5. An earring and associated multiple mechanisms as claimed in claim 1, wherein said backing layer provides a plurality of thread-like elements to which said first side of said two-sided adhesive firmly yet releasably attaches.

* * * * *